US009199151B2

(12) United States Patent
Fu et al.

(10) Patent No.: US 9,199,151 B2
(45) Date of Patent: Dec. 1, 2015

(54) INNER BLADDER STRUCTURE OF PUNCHING BAG

(75) Inventors: Dickson Fu, Taipei (TW); David Fu, New Taipei (TW)

(73) Assignee: Tung-Chien Fu, New Taipei (TW)

( * ) Notice: Subject to any disclaimer, the term of this patent is extended or adjusted under 35 U.S.C. 154(b) by 399 days.

(21) Appl. No.: 13/103,060

(22) Filed: May 7, 2011

(65) Prior Publication Data

US 2012/0157269 A1 Jun. 21, 2012

(30) Foreign Application Priority Data

Dec. 17, 2010 (TW) ..... 99224595 U

(51) Int. Cl.
*A63B 69/20* (2006.01)

(52) U.S. Cl.
CPC ..... *A63B 69/20* (2013.01); *A63B 69/201* (2013.01); *A63B 2225/62* (2013.01)

(58) Field of Classification Search
CPC ... A63B 69/201; A63B 69/20; A63B 21/0602
USPC ..... 482/86, 83, 87, 90, 84, 901, 112; 473/442, 611; D21/798
See application file for complete search history.

(56) References Cited

U.S. PATENT DOCUMENTS

| | | | | |
|---|---|---|---|---|
| 3,748,669 | A * | 7/1973 | Warner | 5/682 |
| 4,103,889 | A * | 8/1978 | Lobur | A63B 69/201 273/DIG. 20 |
| 5,297,944 | A * | 3/1994 | Pomeroy | 417/437 |
| 5,806,768 | A * | 9/1998 | Engel | 239/289 |
| 6,558,298 | B2 * | 5/2003 | Fields et al. | 482/87 |
| 2007/0099772 | A1 * | 5/2007 | Fu | A63B 69/004 482/83 |

* cited by examiner

*Primary Examiner* — Loan H Thanh
*Assistant Examiner* — Rae Fischer
(74) *Attorney, Agent, or Firm* — Raymond Y. Chan; David and Raymond Patent Firm

(57) ABSTRACT

The present invention relates to an inner bladder structure of punching bag which comprises one inner bladder; the said inner bladder further comprises at least one gas container and at least one liquid container. Utilizing liquid, gas and solidifying substances, the said inner bladder structure creates different tactile feels to diversify the effect of training.

3 Claims, 11 Drawing Sheets

INNER BLADDER STRUCTURE OF PUNCHING BAG

BACKGROUND OF THE INVENTION

1. Field of the Invention

The present invention relates to an inner bladder structure of punching bag; particularly one that using liquid and air simultaneously as filler, and the weight and tactile feel of inner bladder can be adjusted in accordance with user's demand.

2. Description of Prior Arts

Conventional inner bladder structure of punching bag is shown in FIG. 1; the foregoing conventional inner bladder is a closed inner bladder using solid (such as sand), liquid (such as water), or gas (such as air) as filler 30 and placed inside one external bag 20.

It is easy and cheap to obtain said filler 30; however, the weight of punching bag impacts on the training effect. When solid is used as filler 30 in inner bladder, the punching bag is heavy and therefore cannot be easily moved and stored. When liquid is solely used as filler 30 in inner bladder, the heaviness of punching bag would result in poor training effect. When gas is used as filler 30 in inner bladder, the punching bag is generally too light in weight and requires other accessories to fix it in place, thus result in poor training effect.

In addition, for conventional punching bag structure, be it adopting solid, liquid, or gas as filler 30, there is only one tactile feel. When filling with solid, punching bag gives a firm texture while filling with liquid adds some softness and resilience. When filling with gas, punching gas is even more resilient. However, none of the foregoing fillers can be adjusted in the structure to create different textures to satisfy user's different training demand.

Thus, there are foregoing drawbacks of conventional inner bladder structure in prior art to be improved.

SUMMARY OF THE INVENTION

To improve drawbacks of prior invention, the present invention provides an inner bladder structure of punching bag allowing users to adjust weight of inner bladder for better training effect.

The present invention discloses an inner bladder structure of punching bag comprising one inner bladder; the said inner bladder further comprises at least one gas container and at least one liquid container.

Wherein, said gas container is an inner bladder for gas storage placed in inner compartment of said inner bladder. Said gas container comprises at least one air valve set installed on one end of said gas container connecting to interior of said gas container. Said liquid container is an inner bladder for liquid storage placed in outer compartment of said inner bladder. Said liquid container comprises at least one water inlet set installed on side or top surface of said liquid container connecting to interior of said liquid container.

The said water inlet set is used to adjust weight of liquid or colloid inside said liquid container and said air valve set is used to adjust pressure and volume of gas inside said gas container. Using said water inlet set and air valve set, allocation of liquid or colloid inside said liquid container can be adjusted, and thus it is possible to adjust weight of inner bladder in accordance with user's demand to obtain better training effect.

Colloid inside said liquid container, which is preferred, is obtained by adding solidifying substances such as Superabsorbent Polymer (SAP) to liquid, to adjust the firmness of said liquid container. Said air valve, at least one, is selected from either inflation valve for balls or air bed valve. Said water inlet set comprises one water inlet and one sealing section to control liquid injection and drain. Said sealing section is concave water plug or manual water valve, and is sealed on one end of the said water inlet.

Aside from foregoing formation and function of inner bladder structure described above, said liquid container additionally comprises at least one air valve set installed on top end of said liquid container connecting to interior of said liquid container. Hardness of said inner bladder can be adjusted by air inflation or exhaust via said air valve set, and thus to adjust tactile feel. Moreover, said inner bladder comprises one fixed-shape ring on top part of said inner bladder and fixed on said liquid container to shape the top of said liquid container as to avoid damage from collapses and wrinkles due to insufficient pressure on top of said liquid container. The fixed-shape ring also serves to make the liquid container a better appearance.

DETAILED DESCRIPTION OF THE PREFERRED EMBODIMENTS

Figure 1:
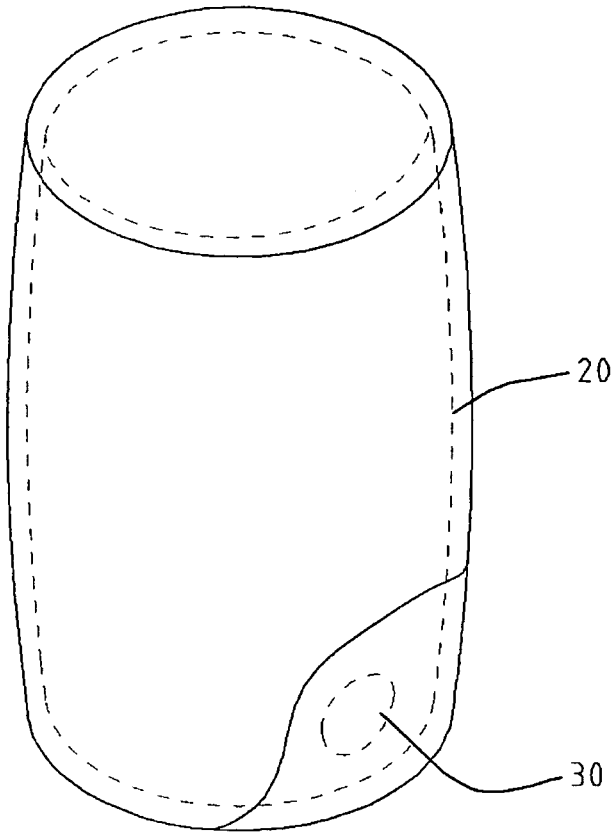
FIG. 1(Prior Art).
FIG. 1 is a three-dimensional view of prior invention.
Figure 2:
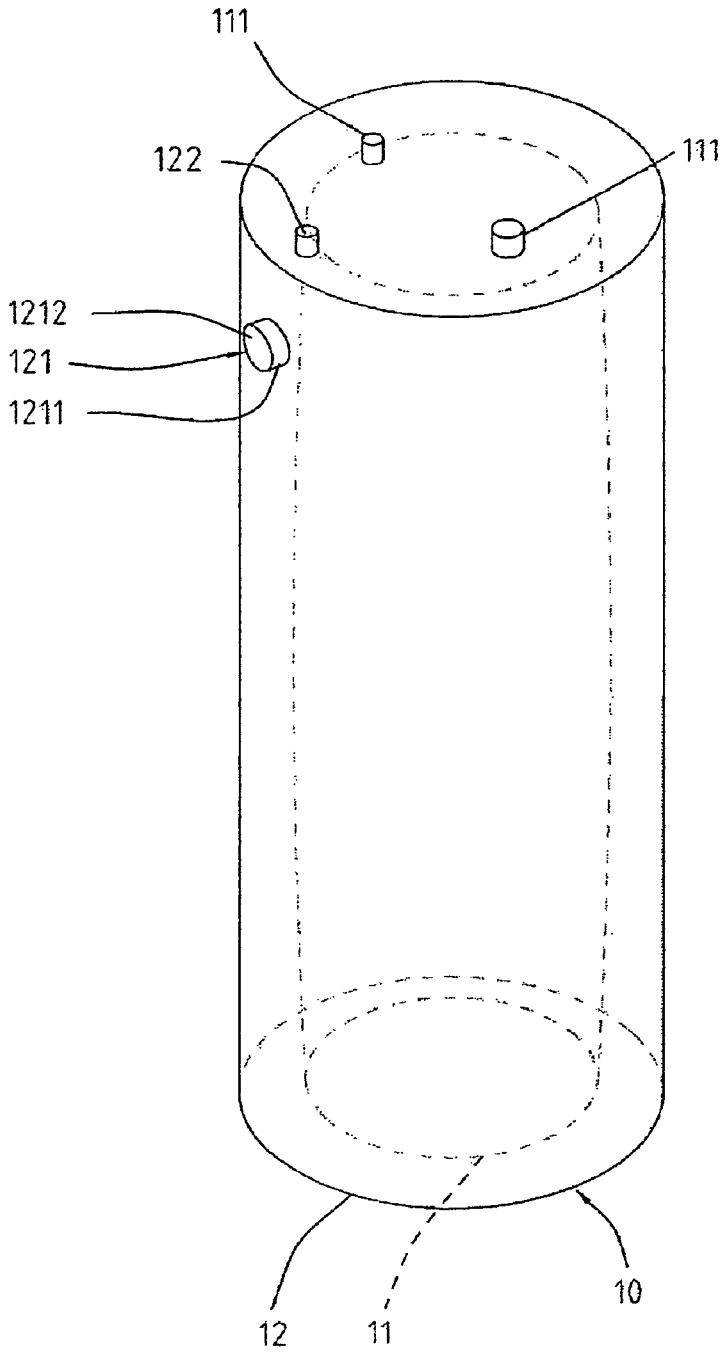
FIG. 2 is a three-dimensional view of embodiment A of present invention.

Please refer to FIGS.2, 3, 4 and 5 which illustrate a three-dimensional view, a sectional view of partial air inflation, a sectional view of water injection, and a sectional view of full air inflation of embodiment A of the inner bladder structure of present invention. Said inner bladder structure is a hollow inner bladder 10 and said inner bladder 10 further comprises:

at least one gas container 11 and at least one liquid container 12;

wherein, said gas container 11 is defined by a side, and two ends for storing gas such as air, and further comprises at least one air valve 111 installed on one end of said gas container 11. Said air valve 111 is an air valve for inflating balls or air beds. It is noted that there are two air valves 111 shown in FIGS. 2 and 5-11. Said liquid container 12 is placed outside said gas container 11 for storing liquid or colloid, and has a side, a top and a bottom with the top and the bottom being joined to the two ends of the gas container 11 respectively to form an annular interior between the two sides. Said liquid container 12 comprises at least one water inlet set 121 and at least one air exhaust valve 122. Said water inlet set 121 is concave and installed on the side of said liquid container 12; said water inlet set 121 further comprises one water inlet 1211 and one sealing section 1212. Said sealing section 1212 is a water plug; and said air exhaust valve 122 is positioned on top side of said liquid container 12, as shown in FIG. 2.

Said air valve 111 communicates with interior of said gas container 11 via the top side of the water container 12 to control air pressure inside said gas container 11. Said water inlet set 121 communicates with the annular interior of said liquid container 12 to control volume of liquid or colloid inside said liquid container 12. Said air exhaust valve 122 communicates with the annular interior of said liquid container 12 to control air exhaust of said liquid container 12; said water plug 1212 is sealed to one end of said water inlet 1211.

Figure 3:
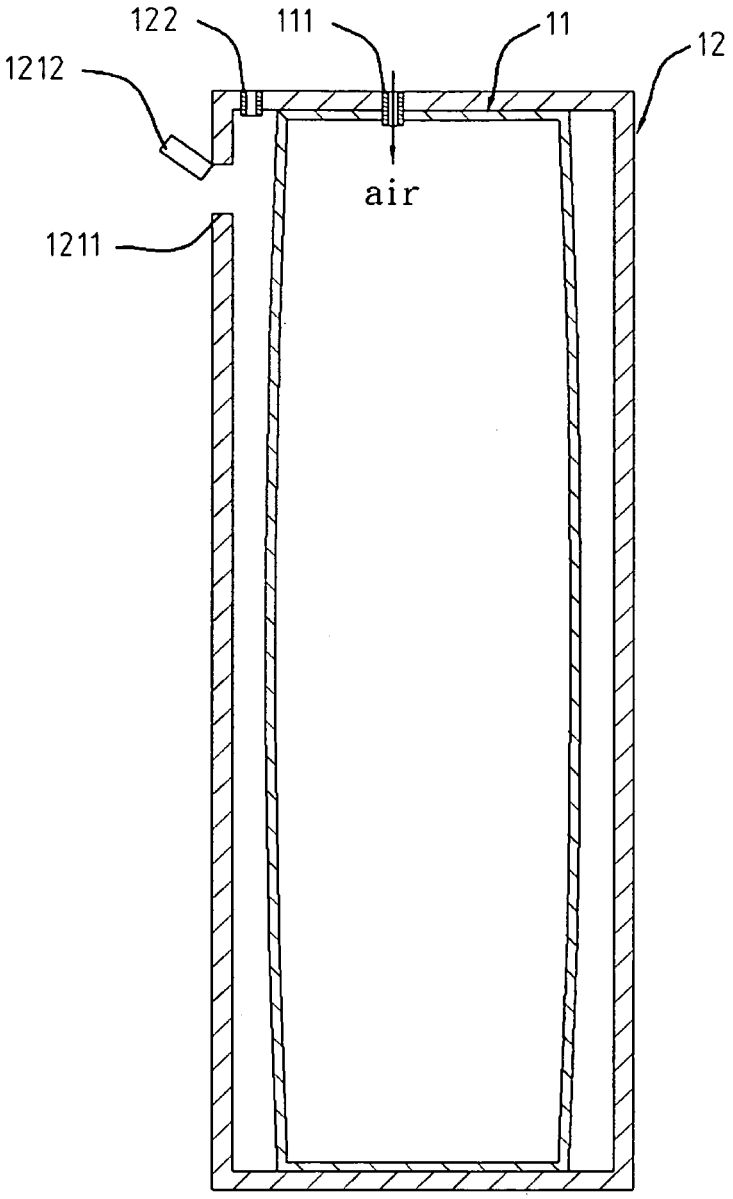
FIG. 3 is a sectional view of embodiment A with partially air inflation.

First inject air into said gas container 11 via air valve set 111. Volume of said gas container 11 will increase due to pressure increase inside said gas container 11 and then volume of said liquid container 12 will reduce as shown in FIG. 3.

Figure 4:
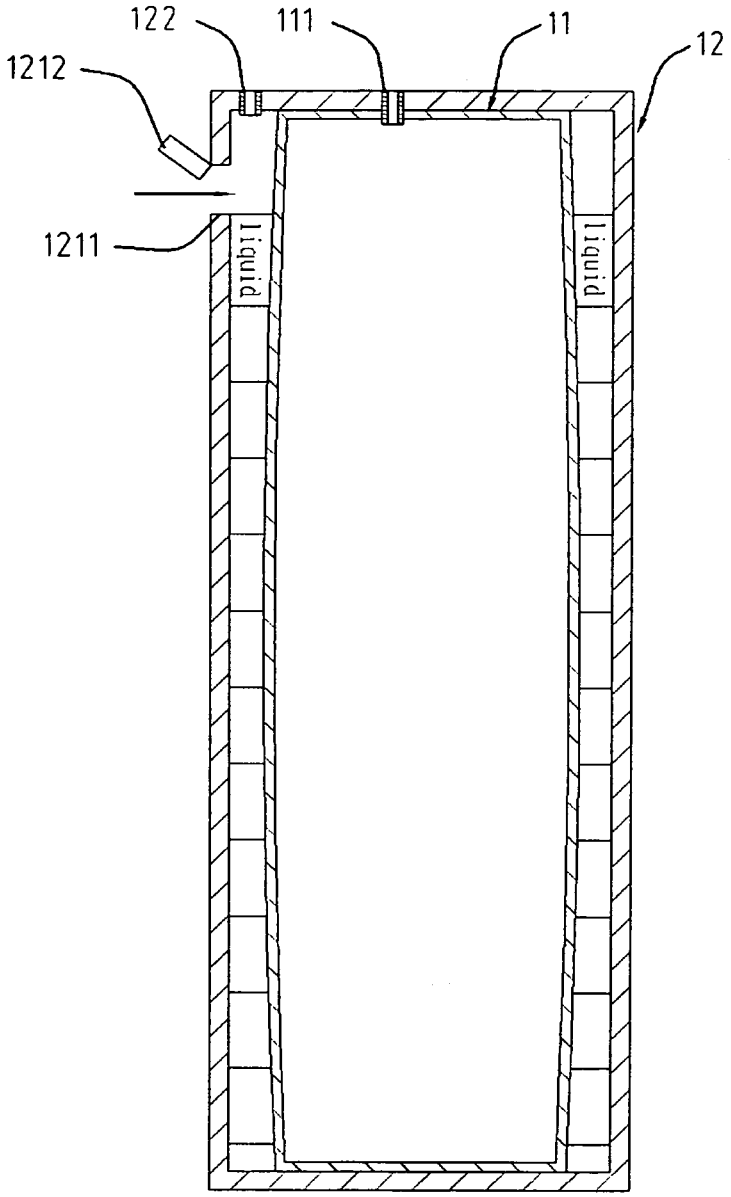
FIG. 4 is a sectional view of water inlet of embodiment A.

Open said water plug 1212 to allow the user to add certain amount of liquid or colloid into said liquid container 12 via said water inlet 1211 in accordance with the user's demand; the added liquid or colloid should not exceed level of said water inlet 1211 as shown in FIG. 4. Meanwhile, on top of liquid or colloid inside said liquid container 12 is filled with air.

Figure 5:
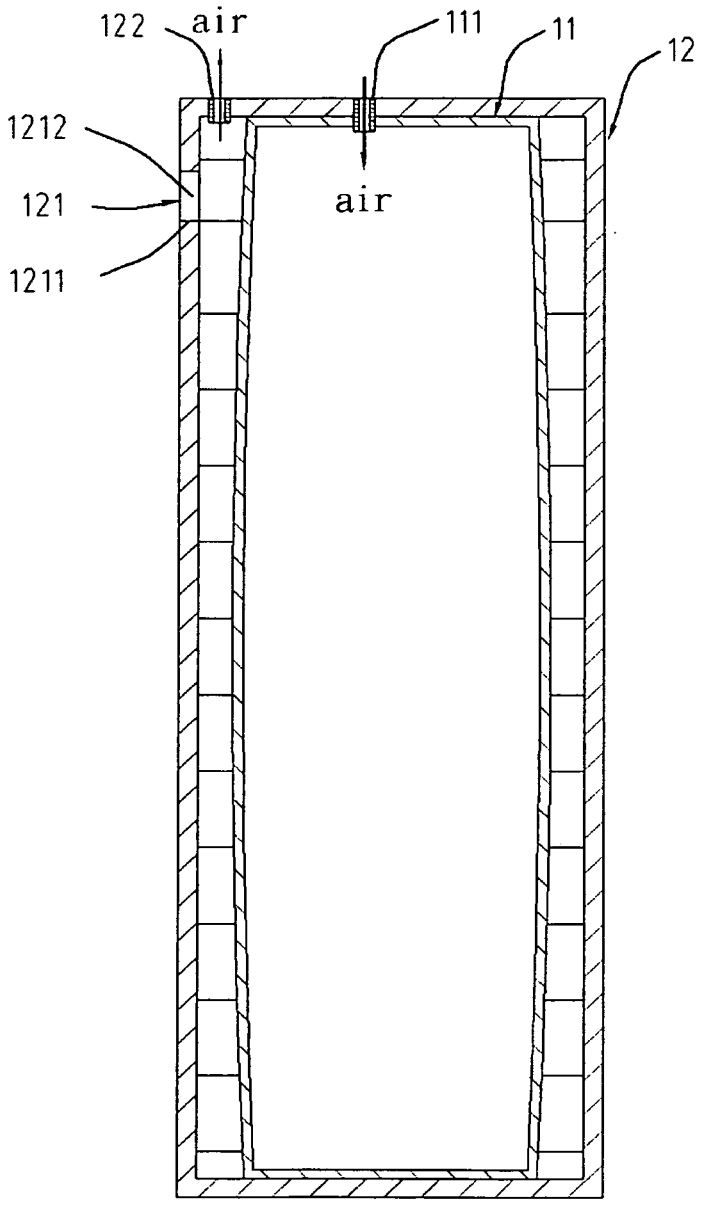
FIG. 5 is a sectional view of embodiment A with full air inflation.

Close said water plug 1212 and open said air exhaust valve 122. Inject air into gas container 11 via said air valve 111. Volume of said gas container 11 will increase due to pressure increase and compress volume of said liquid container 12. The level of liquid or colloid inside said liquid container 12 will rise under compression and air inside said liquid container 12 will exhaust via said air exhaust valve 122 until liquid or colloid starts to flow out of said liquid container 12 via said air exhaust valve 122, which means air inside liquid container 12 is completely exhaust. Meanwhile, stop injecting air into gas container 11 via said air valve 111 and close said air exhaust valve 122 to completely seal said liquid container 12 as shown in FIG. 5.

Said liquid container 12 is completely filled with demanded amount of liquid or colloid in accordance with user's training need to obtain desired tactile feel. Liquid or colloid and air inside said inner bladder 10 can be completely exhausted via said water inlet set 121 and air valve set 111 respectively thus said inner bladder structure is easily to be stored and moved.

If hardness of said inner bladder 10 is desired to be increased, some air can be injected into liquid container 12 via said air exhaust valve 122.

Please refer to FIGS. 6, 7, 8, 9, 10, and 11 for three-dimensional views of various embodiments of inner bladder structure of present invention.

Figure 6:
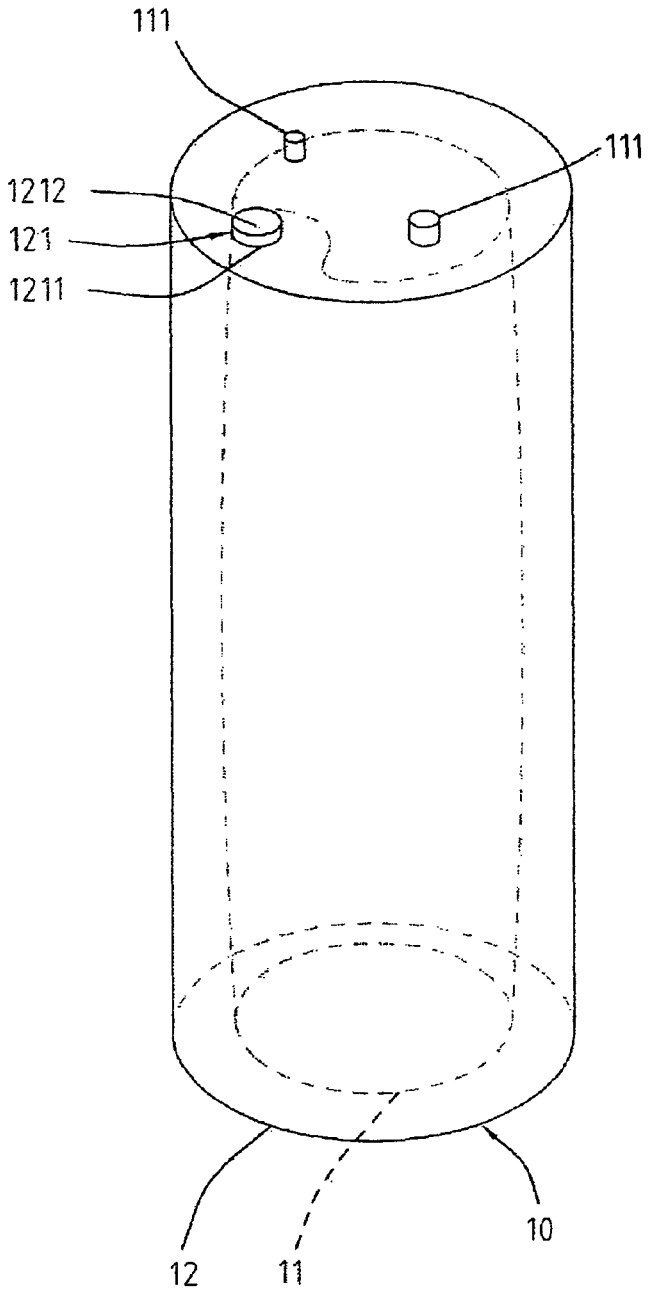
FIG. 6 is a three-dimensional view of embodiment B of present invention.

As shown in FIG. 6, said liquid container 12 comprises at least one water inlet set 121 placed on top side of said liquid container 12. Aside from liquid or colloid injection and drain functions, said water inlet set 121 also provides air exhaust function. Liquid or colloid can be injected to fill said liquid container 12. Other characteristics are the same as shown in FIG. 2.

Figure 7:
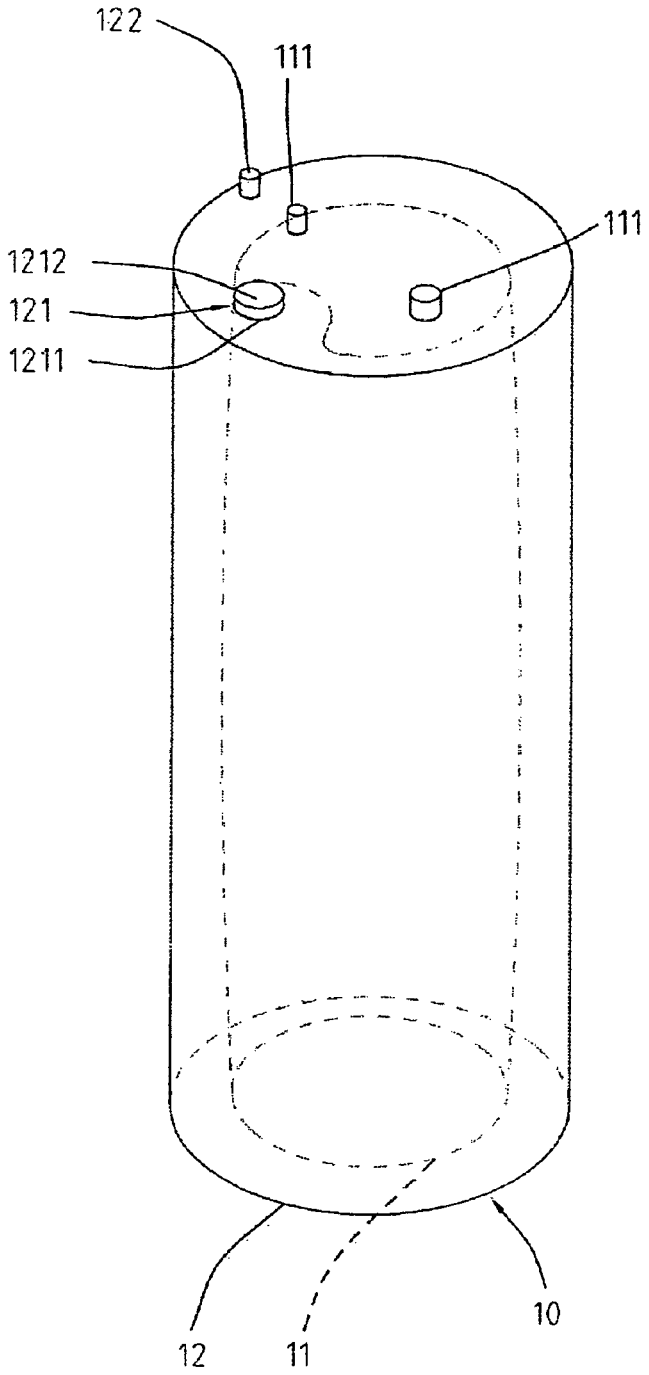
FIG. 7 is a three-dimensional view of embodiment C of present invention.

As shown in FIG. 7, said liquid container 12 comprises at least one water inlet set 121 placed on top side of said liquid container 12 and at least one air exhaust valve 122. Liquid or colloid can be injected to fill said liquid container 12. Other characteristics are the same as shown in FIG. 2.

Figure 8:
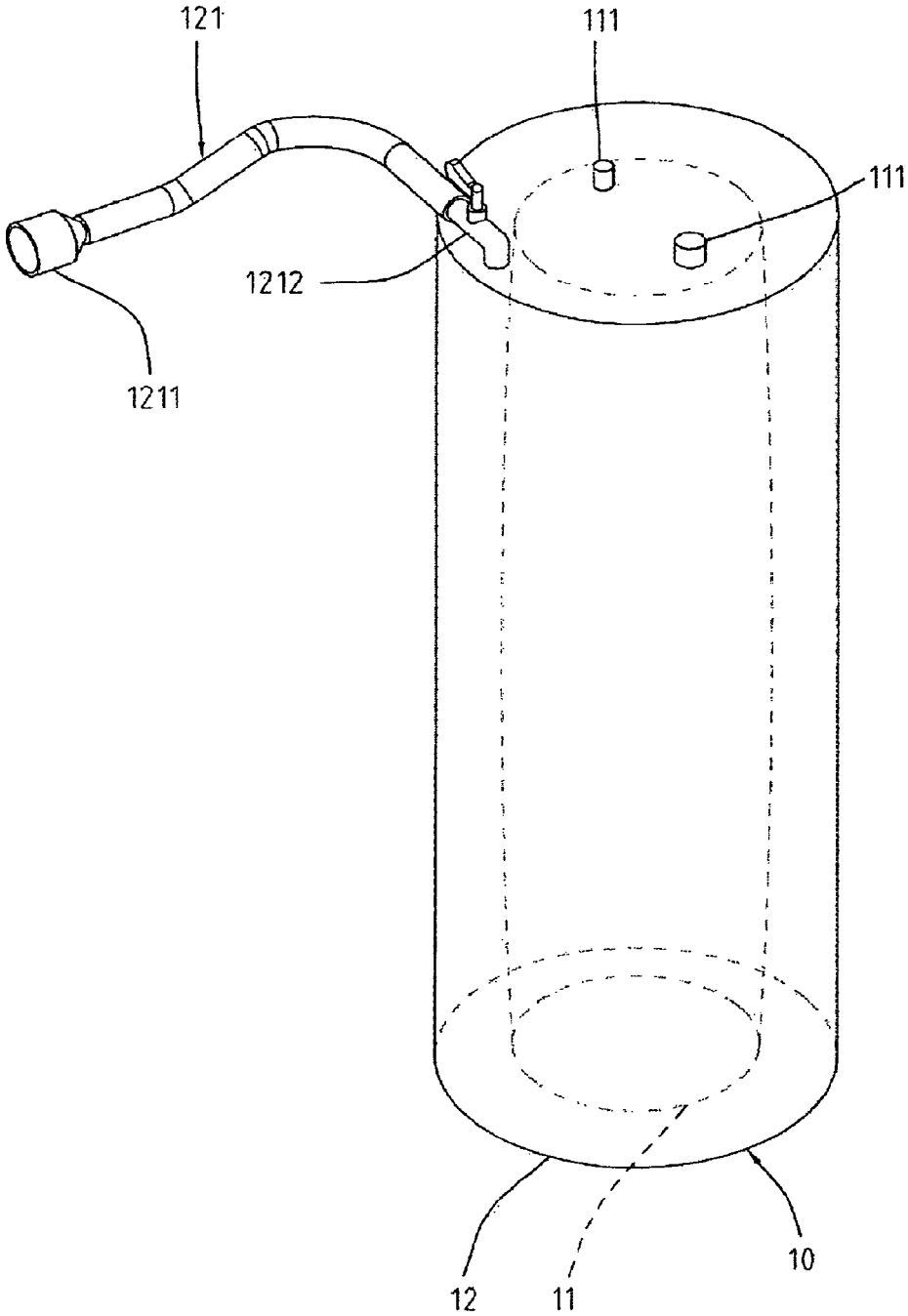
FIG. 8 is a three-dimensional view of embodiment D of present invention.

As shown in FIG. 8, said liquid container 12 comprises at least one water inlet set 121 placed on top side of said liquid container 12. Said water inlet set 121 further comprises one water inlet 1211 and one sealing section 1212. Said sealing section 1212 is a manual water valve. Aside from liquid or colloid injection and drain functions, said water inlet set 121 also provides air exhaust function. Liquid or colloid can be injected to fill said liquid container 12. Other characteristics are the same as shown in FIG. 2.

Figure 9:
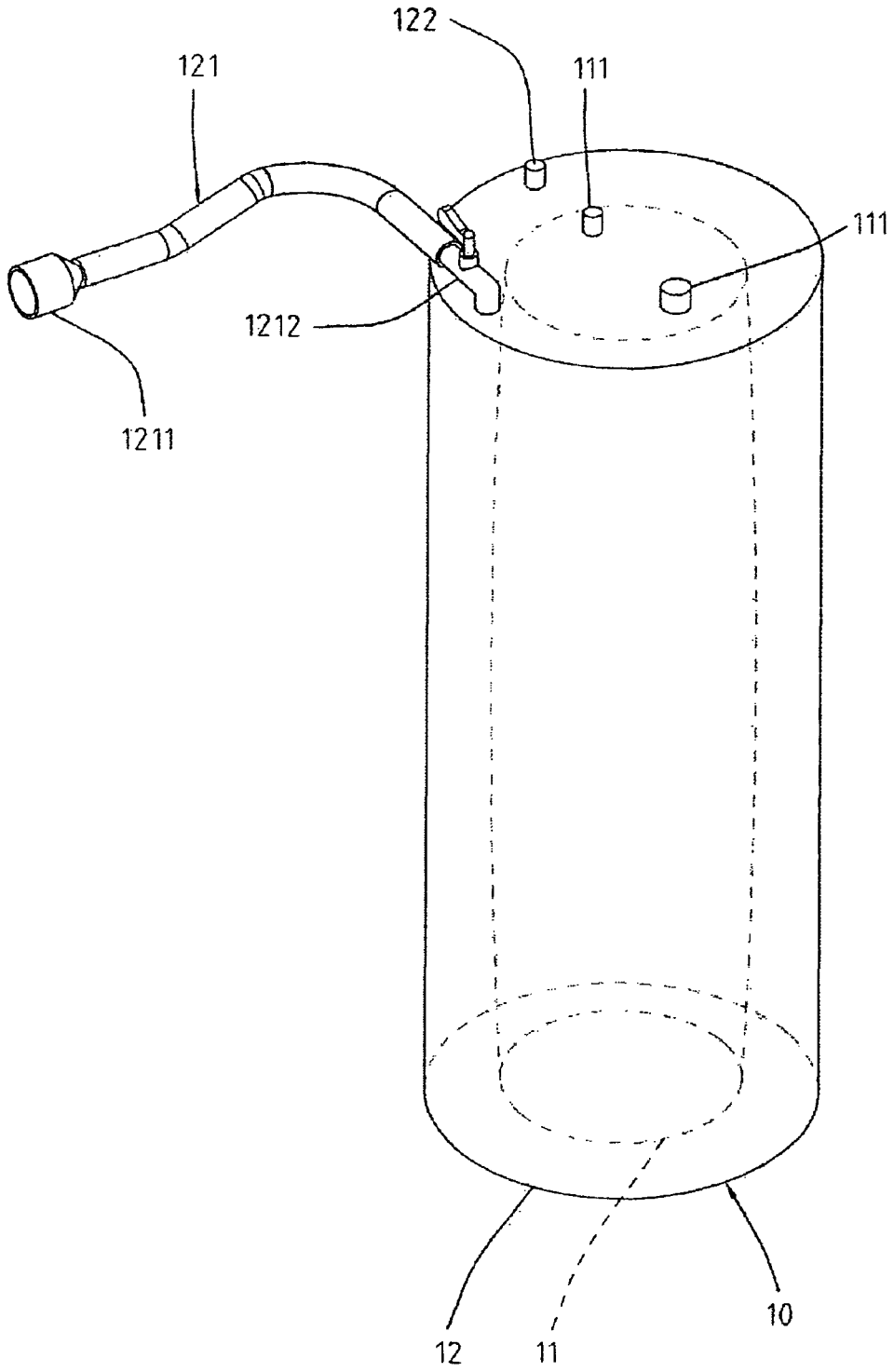
FIG. 9 is a three-dimensional view of embodiment E of present invention.

As shown in FIG. 9, said liquid container 12 comprises at least one water inlet set 121 placed on top side of said liquid container 12 and at least one air exhaust valve 122. Said water inlet set 121 further comprises one water inlet 1211 and one sealing section 1212. Said sealing section 1212 is a manual water valve. Liquid or colloid can be injected to fill said liquid container 12. Air in the liquid container 12 can be exhausted via air exhaust valve 122 to adjust hardness of said inner bladder 10. Other characteristics are the same as shown in FIG. 2.

Figure 10:
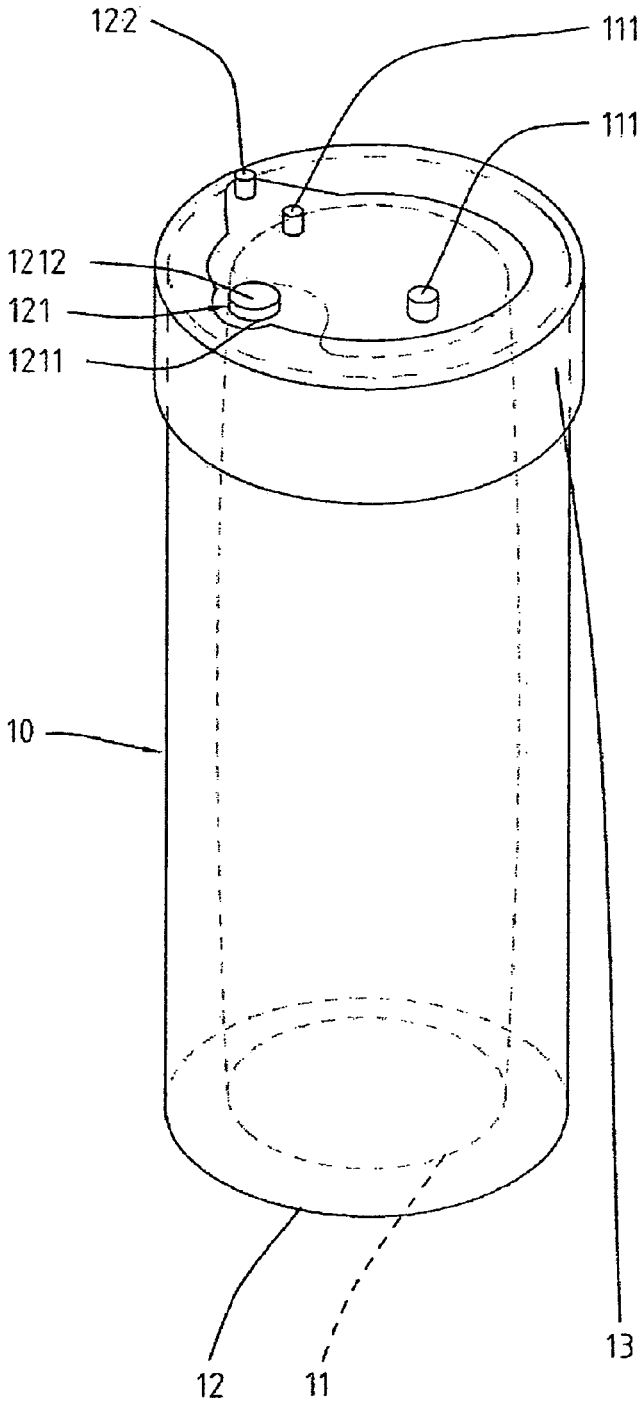
FIG. 10 is a three-dimensional view of embodiment F of present invention.
Figure 11:
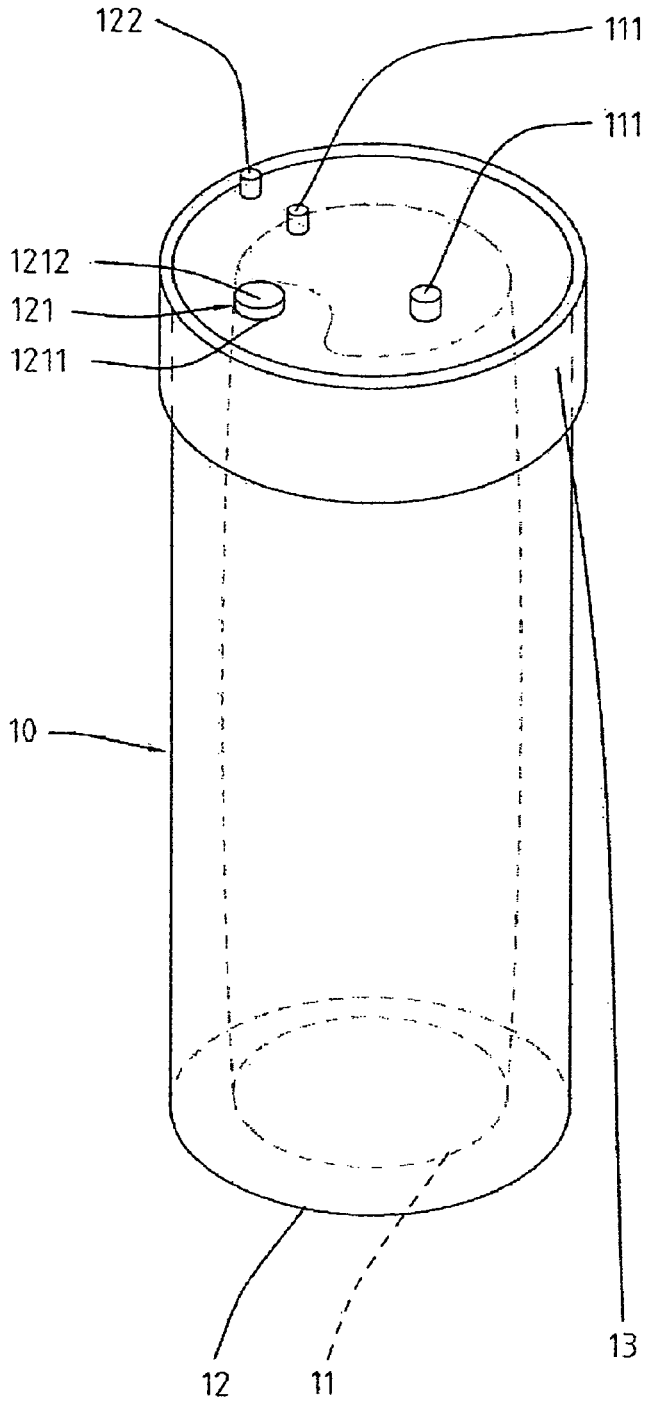
FIG. 11 is a three-dimensional view of embodiment G of present invention.

As shown in FIGS. 10 and 11, said inner bladder 10 of FIG. 7 is installed with a fixed-shape ring 13 disposed on top part and fixed to said liquid container 12 to shape the top of said liquid container 12.

Although the present invention has been explained in relation to its preferred embodiment, it is to be understood that many other possible modifications and variations can be made without departing from the scope of the invention as hereinafter claimed.

What is claimed is:

1. A punching bag, comprising:

a liquid container having a top, a bottom, and a side;

a gas container, having a top, a bottom, and a side, disposed in said liquid container, wherein said top of said liquid container is joined with and overlapped above said top of said gas container while said bottom of said liquid container is joined with and overlapped underneath said bottom of said gas container to define an annular interior between said side of said gas container and said side of said liquid container;

a fixed-shaped ring disposed on and fixed to a top part of said liquid container to shape said to of said liquid container for preventing wrinkles thereof due to insufficient pressure on to of said liquid container;

a water valve provided at said liquid container to communicate with said annular interior, wherein said water valve comprises a water inlet for allowing water to be added into said annular interior, and a sealing section sealed at said water inlet for retaining the water in said annular interior in a sealed manner;

an air inflation valve provided on said top of said liquid container and coupled with said top of said gas container for filling outside air into said gas container within said liquid container so as to adjust an air pressure of said gas container for adjusting tactile feel on said liquid container, wherein when a volume of said gas container increases by increasing said air pressure therein, a volume of said liquid container is reduced and compressed; and an air exhaust valve provided on top of said liquid container for exhausting air in said annular interior when the water is sealed in said annular interior and compressed via an increase of the volume of said gas container, so as to selectively adjust a ratio between the water and air inside said annular interior, such that hardness of said punching bag is adjusted via the air of said annular interior, the air inside said gas container, and the volume of water inside said annular interior.

2. The punching bag, as recited in claim 1, wherein said water inlet is formed at said top of said liquid container.

3. The punching bag, as recited in claim 1, wherein said water inlet is formed at a side of said liquid container.

* * * * *